US010741341B2

(12) United States Patent
Johncock et al.

(10) Patent No.: US 10,741,341 B2
(45) **Date of Patent: *Aug. 11, 2020**

(54) METHOD OF CONTROLLING AN APPLIANCE DOOR POSITION SWITCH FOR SABBATH MODE OPERATION

(71) Applicant: Whirlpool Corporation, Benton Harbor, MI (US)

(72) Inventors: James Charles Johncock, Shelbyville, MI (US); David Wayne Mundy, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/565,942

(22) Filed: Sep. 10, 2019

(65) Prior Publication Data

US 2020/0006017 A1 Jan. 2, 2020

Related U.S. Application Data

(60) Continuation of application No. 16/225,354, filed on Dec. 19, 2018, now Pat. No. 10,453,627, which is a continuation of application No. 15/918,238, filed on Mar. 12, 2018, now Pat. No. 10,204,752, which is a continuation of application No. 15/661,350, filed on (Continued)

(51) Int. Cl.
*H01H 9/28* (2006.01)
*H01H 3/16* (2006.01)

(52) U.S. Cl.
CPC ..... *H01H 9/286* (2013.01); *H01H 9/287* (2013.01); *H01H 3/161* (2013.01); *H01H 2221/068* (2013.01); *H01H 2231/012* (2013.01); *H01H 2300/024* (2013.01)

(58) Field of Classification Search
CPC ..... H01H 9/286; H01H 9/287; H01H 3/161; H01H 2221/068; H01H 2231/012; H01H 2300/024; H01H 2221/036
USPC ..... 200/43.01, 333, 331, 43.16–43.22, 332, 200/337, 304, 338
See application file for complete search history.

(56) References Cited

U.S. PATENT DOCUMENTS 2,214,567 A 9/1940 Rosenthal
3,511,956 A 5/1970 Fields
(Continued)

FOREIGN PATENT DOCUMENTS

WO 2013084220 A1 6/2013

*Primary Examiner* — Edwin A. Leon
(74) *Attorney, Agent, or Firm* — Price Heneveld LLP

(57) ABSTRACT

A method for selectively restricting movement of an appliance position switch from a closed position to an open position includes positioning the pin within a channel of a body portion of a switch retention device and moving the body of the switch retention device in a first direction into an opening in a face of the appliance within which the pin is moveable from the open position to the closed position. Such movement is carried out to cause movement of the pin in the first direction toward the closed position. The method further includes continuing to move the switch retention device in the first direction such that a cap thereof contacts the face, and a tab extending outwardly from the body engages with the opening to retain the switch retention device in the opening and the pin in the closed position.

20 Claims, 4 Drawing Sheets

Related U.S. Application Data

Jul. 27, 2017, now Pat. No. 9,953,773, which is a division of application No. 14/713,577, filed on May 15, 2015, now Pat. No. 9,734,961.

(56) References Cited

U.S. PATENT DOCUMENTS

| | | | | |
|---|---|---|---|---|
| 4,218,602 | A | 8/1980 | Creech | |
| 4,827,603 | A | 5/1989 | Akhter | |
| 5,363,720 | A | 11/1994 | Sanchez | |
| 5,750,948 | A | 5/1998 | Atmonett et al. | |
| 5,808,278 | A | 9/1998 | Moon et al. | |
| 6,066,837 | A | 5/2000 | McCormick et al. | |
| 6,703,591 | B2 | 3/2004 | Daum et al. | |
| 6,974,925 | B2 | 12/2005 | Whitman | |
| 8,669,501 | B2 | 3/2014 | Frommer | |
| 8,790,331 | B2 | 7/2014 | Stanton | |
| 9,734,961 | B2 | 8/2017 | Johnock et al. | |
| 9,953,773 | B2 * | 4/2018 | Johncock | H01H 9/286 |
| 2003/0174590 | A1 * | 9/2003 | Arikawa | G04B 37/106 368/319 |
| 2007/0103887 | A1 | 5/2007 | Bleier et al. | |
| 2011/0050385 | A1 | 3/2011 | Hofsaess | |
| 2017/0323743 | A1 | 11/2017 | Johncock et al. | |
| 2018/0204691 | A1 | 7/2018 | Johncock et al. | |

* cited by examiner

METHOD OF CONTROLLING AN APPLIANCE DOOR POSITION SWITCH FOR SABBATH MODE OPERATION

CROSS-REFERENCE TO RELATED APPLICATION

This application is a continuation of U.S. patent application Ser. No. 16/225,354, filed Dec. 19, 2018, entitled "METHOD OF CONTROLLING AN APPLIANCE DOOR POSITION SWITCH FOR SABBATH MODE OPERATION," now U.S. Pat. No. 10,453,627, which is a continuation of U.S. patent application Ser. No. 15/918,238, filed Mar. 12, 2018, entitled "METHOD OF CONTROLLING AN APPLIANCE DOOR POSITION SWITCH FOR SABBATH MODE OPERATION," now U.S. Pat. No. 10,204,752, which application is a continuation of U.S. patent application Ser. No. 15/661,350, filed on Jul. 27, 2017, entitled "METHOD OF CONTROLLING AN APPLIANCE DOOR POSITION SWITCH FOR SABBATH MODE OPERATION," now U.S. Pat. No. 10,204,752, which is a division of U.S. patent application Ser. No. 14/713,577, filed on May 15, 2015, entitled "METHOD OF CONTROLLING AN APPLIANCE DOOR POSITION SWITCH FOR SABBATH MODE OPERATION," now U.S. Pat. No. 9,734,961, the entire disclosures of which are incorporated herein by reference in their entirety.

BACKGROUND

The present device generally relates to retaining an appliance position switch in a desired position. In particular, the device includes a body with a pin-receiving channel therein and a tab to retain the device and the pin in a depressed position within an opening.

Various types of appliances may include a position switch for determining whether a door thereof is in a closed position or an at least partially open position. In an example, some appliances, such as ovens and refrigerators include lights on the interiors thereof that illuminate when their doors are moved out of the closed position to, for example, to provide additional visibility. In a similar manner, the position switches causes the interior lights to turnoff when the appliance door is in or is moved into the closed position. In further examples, position switches can be used by a control system or other circuitry of an appliance to indicate whether a door is closed or at least partially open. Such a control system may then cause illumination, as needed, of interior lights and may provide additional functionality in response to a door being at least partially open. This additional functionality may include sounding an alarm after a door being left open for predetermined time or the deactivation of various oven modes (i.e. self-cleaning) when the door of an oven is detected as not fully closed.

Some users or owners of appliances including such position switches may for various reasons, including religious reasons, desire that internal appliance lights not illuminate in response an appliance door being moved out of the closed position. In a particular example some may, for religious reasons, be prohibited from turning on, or causing to be turned on, any lights or the like during a time period of Sabbath observation. This may, accordingly, result in the inability to use appliances at all, simply because of the illumination of lights caused by opening and closing of doors. Accordingly, further advances are desired to prevent such illumination of appliance lights, according to the desires of a user.

SUMMARY

In at least one aspect, a method for selectively restricting movement of an appliance position switch from a closed position to an open position includes positioning the pin, when in the open position, within a channel of a body portion of a switch retention device. The method further includes moving the body of the switch retention device in a first direction into an opening in a face of the appliance within which the pin is moveable from the open position to the closed position. Such movement is carried out with the pin in the channel to cause movement of the pin in the first direction toward the closed position. The method further includes continuing to move the switch retention device in the first direction such that a cap thereof contacts the face, and a tab extending outwardly from the body engages with the opening to retain the switch retention device in the opening and the pin in the closed position.

In at least another aspect, a position switch retention device for use with an appliance including a body defining a first end, a cap extending outwardly from a second end of the body opposite the first end, a first tab extending from a side of the body. The first tab defines a ramp extending away from the body to an edge directed toward and spaced from the cap.

In at least another aspect, a device for securing a position switch of an appliance in a depressed position includes a body defining an open-sided profile along at least a first portion thereof, the open-sided profile having a first width. The device further includes a cap extending outwardly from a second end of the body opposite the first end and having a second width greater than the first width.

These and other features, advantages, and objects of the present device will be further understood and appreciated by those skilled in the art upon studying the following specification, claims, and appended drawings.

DETAILED DESCRIPTION OF EMBODIMENTS

Figure 1:
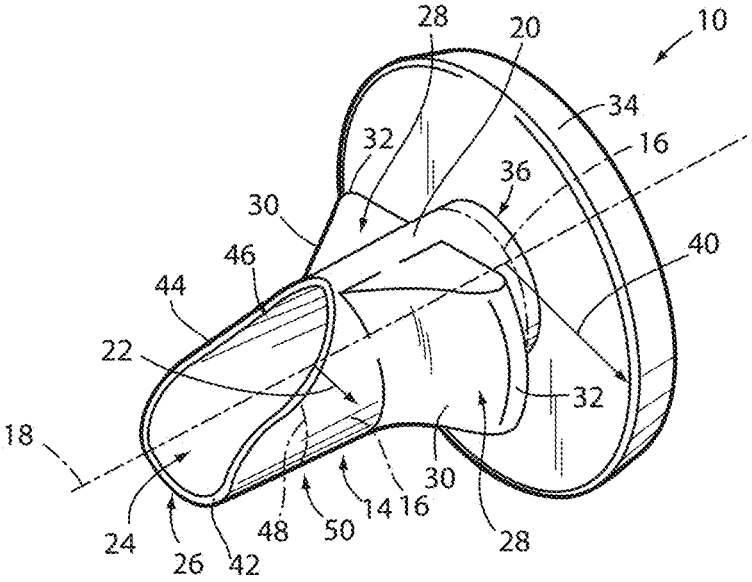
FIG. 1 is a perspective view of a position switch retention device.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to the embodiment illustrated in FIG. 1, reference numeral 10 generally designates a position switch retention device for use with an appliance 12. Device 10 includes a body 14 defining a generally cylindrical profile 16 extending along an axis 18 within a first portion 20 of the body 14. The cylindrical profile 16 further defines a first radius 22. Body 14 further defines a pin receiving channel 24 open on at least a first end 26 of body 14 and positioned at least partially within the generally cylindrical profile 16. Device 10 further includes a first tab 28 extending from a side of body 14. Tab 28 defines a ramp section 30 and an edge 32 such that the ramp 30 extends away from first end 26 of body 14 to the edge 32. A cap 34 extends outwardly from a second end 36 of body 14 opposite first end 26. Cap 34 is spaced apart from the edge 32 of tab 28 at a first distance 38 and, further, has a second radius 40 that is greater than the first radius 22.

Figure 2:
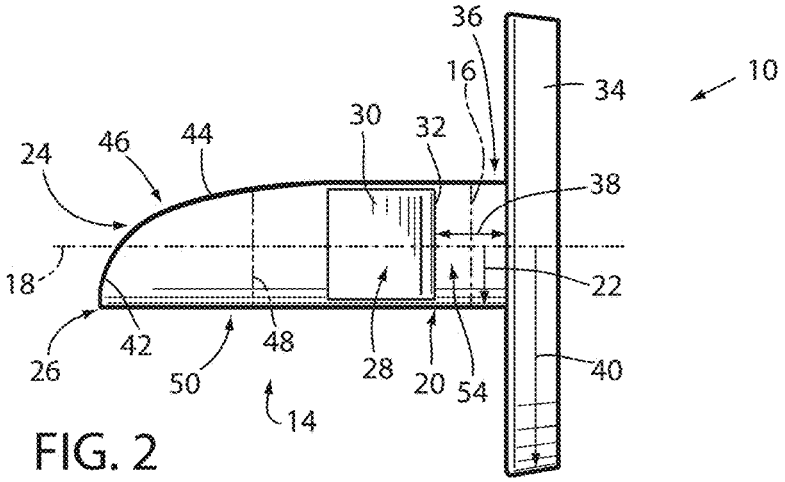
FIG. 2 is a side elevation view of the position switch retention device of FIG. 1.
Figure 3:
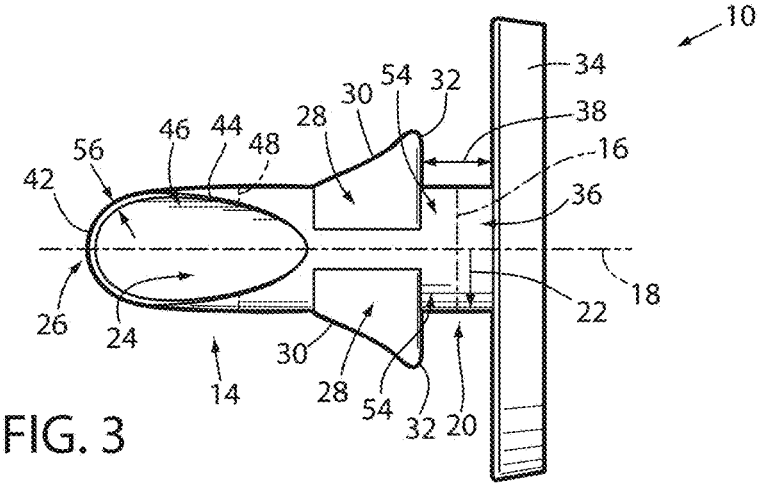
FIG. 3 is a top view of the position switch retention device of FIG. 1.

As shown in FIGS. 1-3, first end 26 of body 14 defines a tip 42 that is rounded when viewed along a first plane that is laterally oriented in the manner of the direction of the page with respect to the depiction of device 10 in FIG. 3. Although the rounded tip portion 42 of body 14 may define a compound curvature extending in multiple directions, when viewed from the orientation shown in FIG. 3, (or, for example, a lateral plane extending through axis 18) the rounded tip 42 will define a generally rounded projection onto such a plane extending from one side of body 14 to the other, and may meet the adjacent sides of body 14 in a tangential manner. As further shown in FIG. 2, body 14 may also define a curved slopping profile 44 with respect to a second plane that is perpendicular to the first plane, such as the direction of the page in FIG. 2. The sloped profile 44 may interact with or be generally continuous with the round tip 42 so as to define a compound curve along a mutually-defined edge of body 14. As shown in FIGS. 1-3, such a curve may inscribe a section of body 14 in the manner of a closed loop thereon.

Continuing with respect to FIGS. 1-3, the positioning of channel 24 within body 14 and open on first end 26 thereof is such that the combined edge formed by round tip 42 and sloped profile 44 of body 14 further interacts with channel 24 itself. In this manner, channel 24 may define a generally continuous opening 46 extending from first end 26 upwardly and rearwardly, generally following sloped profile 44, on a side of body 14. The presence of such opening 46 may be such that body 14 defines a generally U-shaped profile 48 within a second portion 50 of body 14. In the embodiment illustrated in FIGS. 1-3, the upper edge of U-shaped profile 48, as defined by sloped profile 44 may define an open upper end of the U-shaped profile 48 that tapers gradually inwardly in a direction from first end 26 to second end 36, such that the U-shaped profile 48 closes along such a direction to transition into the cylindrical profile 16. As an alternative, the U-shaped profile 48 may be generally uniform, at least along a portion thereof, so as to end abruptly at the beginning of cylindrical profile 16.

As further shown in FIGS. 1-3, device 10 may include a pair of tabs 28, with a second of such tabs 28 being positioned laterally opposite the first tab 28. In various alternatives, device 10 may include only a single tab 28 extending from a portion of body 14 or may include a single tab 28 that encircles generally the entire outer profile of body 14. As illustrated, tabs 28 define a ramp 30 in the form of a sloped section extending outwardly from body 14, such ramp portions 30 intersecting with an outer profile of body 14 within first portion 20 and extending outwardly from body 14 in a direction from first end 26 to second end 36. Ramps 30 extend to edges 32 defined by a surface that abruptly extends back toward body 14, thereby defining the edges 32 of tabs 28.

As will be described further below, tabs 28 are shaped as such so as to help retain device 10 within the structure of an appliance 12 adjacent a position switch 52 thereof (as shown in FIGS. 4-7). To further facilitate the ability of tabs 28 to retain device 10 with appliance 12 in the area of position switch 52, while still allowing assembly and disassembly thereof without excessive force, tabs 28 may be made generally flexible (i.e. inwardly with respect to axis 18 in a flexing manner and outwardly with respect to axis 18 to return to a natural position thereof). As such, device 10 may be a single piece of material with the various features thereof discussed herein being integrally formed together. In an example, such material may be a polymeric material such as various plastics or the like. In a further example, device 10 can be of an injection molded polymeric material such as polypropylene, polyethylene, polycarbonate, or the like. A device 10 of such a material, and as shown in FIGS. 1-3 may provide for the above-described flexing of tabs 28 by permitting some compression of tabs 28 themselves, and also by deformation of body 14 in respective areas 54 adjacent tabs 28. The flexing in this manner may be facilitated by the hollow nature of body 14 by way of channel 24 extending generally therethrough, at least in the area of flexible regions 54. Such an arrangement may give body 14 a wall thickness 56, defined between the channel 24 and the outside of body 14, that, depending on the particular material, may give regions 54 a desired level of flexibility and resiliency. In one example, wall thickness 56 may be between about 0.7 mm and 2 mm. In a further embodiment, wall thickness 56 is about 1 mm. In an embodiment wall thickness 56 may be generally constant throughout body, with channel 24 extending therethrough such that an inside surface 58 of body 14, defined at an end of channel 24 adjacent second end 36 of body 14 is generally continuous with an adjacent portion of cap 34, such that body 14 is substantially hollow and is enclosed on end 36 by cap 34.

Device 10, as described with respect to FIGS. 1-3 may be used in connection with an appliance 12, as shown in FIGS. 4-7, to retain a position switch 52 thereof in a particular orientation or position with respect to appliance 12. In the example shown in FIG. 4, appliance 12 is in the form of a range including an oven 60. In an alternative embodiment, an appliance may be a standalone or wall mounted oven or the like. In general, an oven 60 as depicted in connection with the appliance 12 of FIG. 4, may include a position switch 52 including a pin 62 projecting outwardly from an opening 64 in a face 66 of appliance 12. Face 66 may be a mating face 66 with door 68 of the oven 60, such that door 68 closes against face 66 when oven 60 is in a closed position. In this manner, pin 62 may be pressed inwardly into opening 64 by door 68 when door 68 is in the closed position. Further, pin 62 may be biased outwardly by a spring force from opening 64 so as to have a natural position extending outwardly from face 66 of appliance 12. In this manner, when door 68 of oven 60 is opened, pin 62 extends outwardly from opening 64. Such a structure of position switch 52 may allow for use thereof in connection with functionality of appliance 12 that indicates or otherwise corresponds with the position of door 68 in either a fully closed position or an at least partially opened position.

In one example, appliance 12 may include a light 70 within oven 60 that may illuminate when door 68 is moved out of the closed position, for example, to provide additional visibility within oven 60. In a similar manner, position switch 52 may cause light 70 to be turned off when door 68 is in, or is moved into the closed position. In an example, position switch 52 may be a simple switch that may be wired in series with light 70 and a power source thereof so as to directly control the switching of light 70 from on to off and vice-versa. In another example, switch 52 may be a resistance switch or the like that can be used by a control system or other circuitry of appliance 12 to indicate whether door 68 is closed or at least partially open. Such a control system may then cause illumination, as needed, of light 70 and may, further, provide additional functionality in response to door 68 being at least partially open, such as the sounding of an alarm during after door 68 has been opened for a predetermined time or the deactivation of various oven modes (i.e. self-cleaning) when the door 68 of oven 60 is detected as not fully closed.

As indicated above, device 10 can be assembled with appliance 12 to interfere with the above-described normal operation of position switch 52, including movement of pin 62 in response to opening and closing of door 68 with respect to oven 60. In the example shown in FIGS. 4-7, device 10 can be assembled over pin 62 and pressed into and engaged with opening 64 such that pin 62 is retained in a position corresponding to door 68 of oven 60 being in the closed position (regardless of the actual position of door 68). Thusly, in the example described above in which position switch 52 controls the illumination of light 70, installation of device 10 in connection with position switch 52 will serve to maintain the oven light 70 in an un-illuminated state regardless of the position of door 68. In some instances such installation may also disable additional functions connected with the position of door 68, including various alarms or other indicators.

Figure 4:
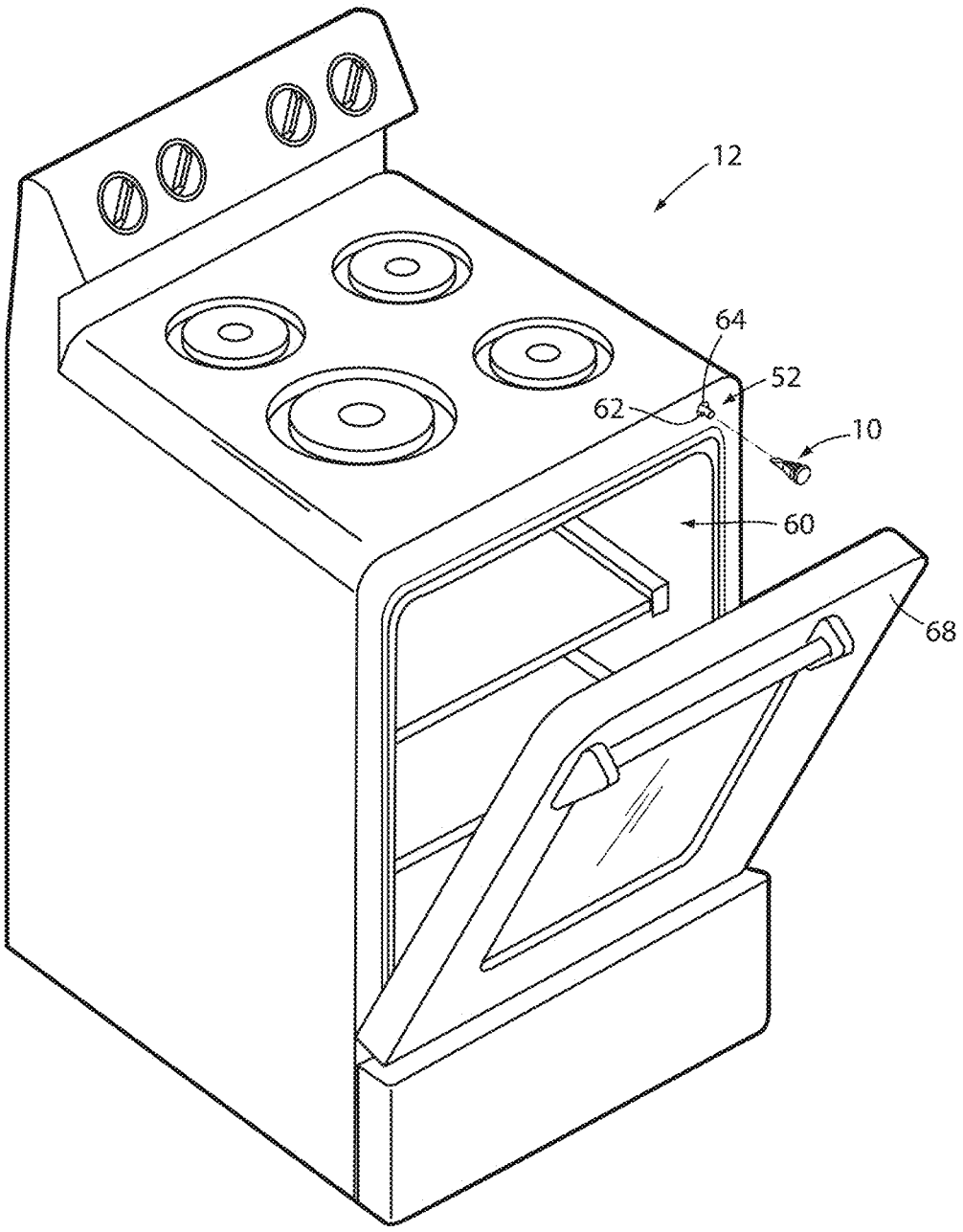
FIG. 4 is an assembly view of the position switch retention device with a position switch of an appliance.
Figure 6:
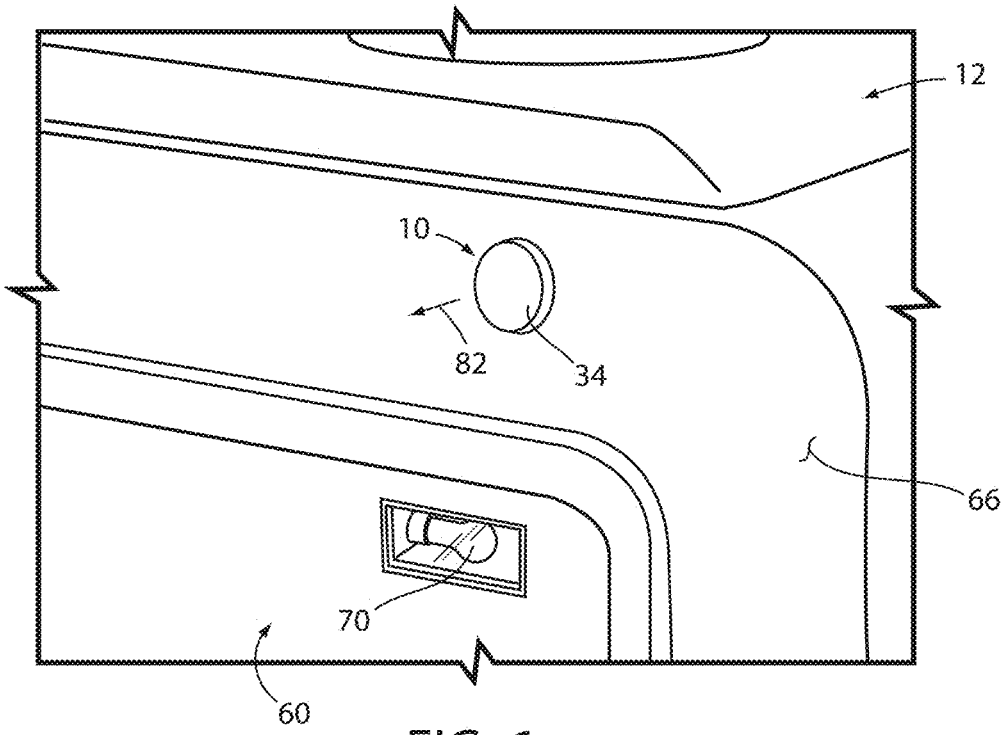
FIG. 6 is a detail view showing the position switch retention device in an assembled configuration with the appliance of FIG. 4.

In an example, some users or owners of an appliance 12, such as depicted in FIG. 4, may for various reasons, including religious reasons, desire that light 70 not illuminate in response to door 68 being moved out of the closed position. In a particular example some may, for religious reasons, be prohibited from turning on caused to be turned on lights or the like, such as light 70, during a time period of Sabbath observation. For some this may, accordingly, result in the inability to use oven 60, simply because of the illumination of light 70 caused by opening and closing of door 68. Accordingly, device 10 may be installed over pin 62 prior to the beginning of Sabbath observation to allow use of oven 60 therethrough. Device 10 then may be removed from appliance 12 (by movement in direction 82, as shown in FIG. 6) after the conclusion of Sabbath observation, to allow light 70 to function normally with opening and closing of door 68.

Figure 5:
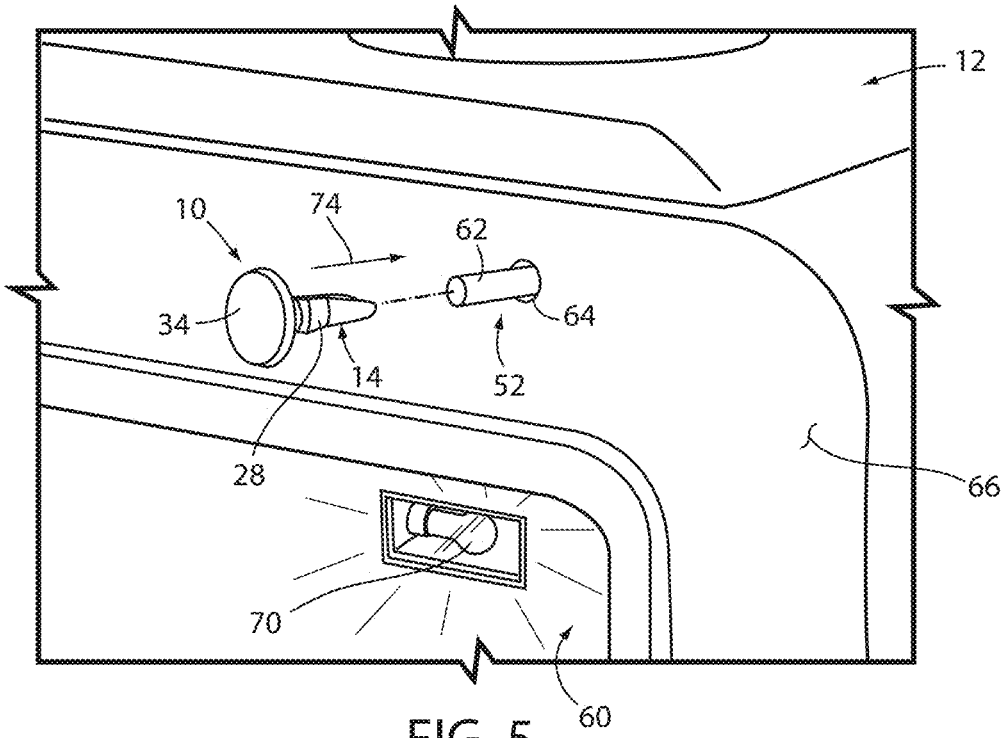
FIG. 5 is a detail assembly view of the position switch retention device and appliance position switch of FIG. 4.

As shown in FIG. 5, device 10 may be installed with respect to appliance 12 by aligning device 10 with pin 62 and positioning device 10 with respect to pin 62 such that pin 62 aligns with the opening 46 to channel 24. In an example, this may be done by aligning the axis 18 of body 14 with a similar axis of pin 62. Alternatively, because opening 46 may extend along an end 26 and a side of body 14, pin 62 may be aligned with opening 46 by positioning of body 14 at least partially alongside pin 62. Subsequently, device 10 is moved such that body 14 engages with pin 62. In the examples described above this can include movement of device 10 along axis 18 such that pin 62 slides into channel 24. Alternatively, body 14 can be snapped over pin 62 by sideways movement of device 10 with respect to pin 62, thusly causing device 10 to snap onto pin 62. In either such manner, the U-shaped profile 48 of body 14 within second portion 50 may allow for engagement of body 14 with pin 62 without causing movement of pin 62. As will be understood from the additional disclosure, such inward movement of pin 62 during engagement of body 14 therewith may cause jamming or interference as device 10 is further assembled with appliance 12.

After assembly of device 10 with pin 62, device 10 may be moved along axis 18 in first direction 74 such that body 14 moves into opening 64. The aforementioned round tip 42 of body 14, as well as the sloped profile 44 along the initial portions of U-shaped profile 48 may prevent an edge of body 14 from catching on an adjacent portion of opening 64 as body 14 is moved thereinto. Movement of device 10 in direction 74 is continued until cap 34 contacts face 66 of appliance 12 in the area adjacent opening 64. Such movement, thusly, includes movement of tabs 28 into opening 64, which may be facilitated by the above-described inward flexing thereof. Further, as device 10 is moved in first direction 74 during movement of body 14 into opening 64, pin 62 extends into channel 24 until such a point that inside surface 58 along the closed end of channel 24 contacts the adjacent end of pin 62, which may, for example, occur prior to contact of cap 34 with face 66, at which point, continued movement of device 10 in first direction 74 causes movement of pin 62 against the spring biasing force thereof into the closed position shown in FIG. 7.

Figure 7:
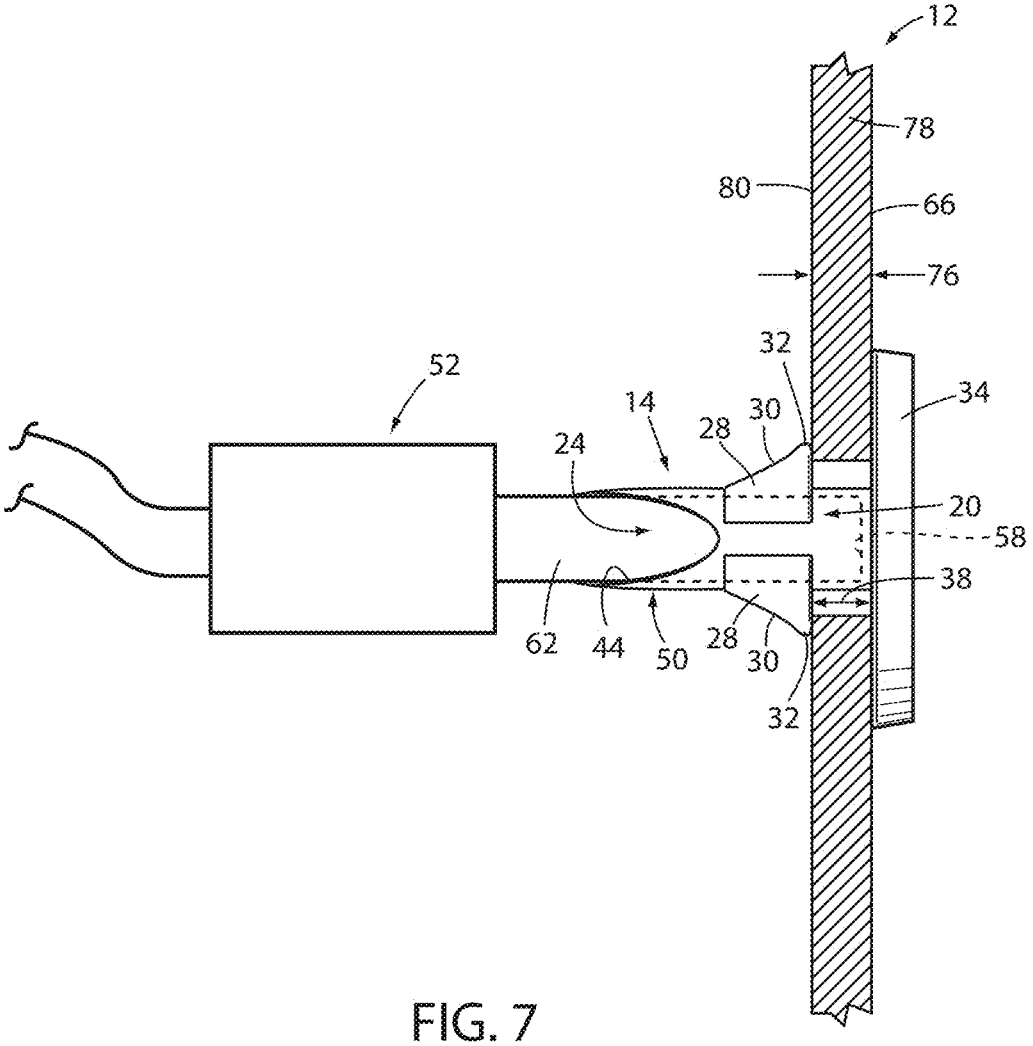
FIG. 7 is a cross-sectional view of the assembled position switch retention device and appliance taken along line VII-VII in FIG. 6.

As shown in FIG. 7, the first distance 38 between the edges 32 of tabs 28 and cap 34 may generally correspond to a thickness 76 of a wall 78 of appliance 12 on which face 66 is defined and through which opening 64 passes. In this manner, the edges 32 of tabs 28 may engage with an inside surface 80 of wall 78 opposite face 66 when cap 34 is in contact therewith. This engagement may provide a retention force of device 10 within opening 64 that exceeds the spring biasing force of pin 62 with respect to switch 52, thereby retaining device 10 within opening 64 and, accordingly, pin 62 in the closed position, as shown in FIG. 7. Once thusly installed, device prevents pin 62 from moving out of the closed position, which in turn prevents light 70 from illuminating, even when door 68 is opened.

Device 10 may be specifically structured to properly engage with opening 64 and pin 62, according to the particular geometry thereof in connection with the particular appliance 12 in which they are included. Such specific structuring may include a particular wall thickness 56 of body 14 such that body 14 can fit within a space between opening 64 and in 62. Further, the cylindrical profile 16 and U-shaped profile 48 of body 14 may be sized so as to receive pin 62 therein without unnecessary interference therewith. In an example, first radius 22 may be between 0.8 cm and 1.5 cm, depending on the particular size of pin 62, given the aforementioned range of wall thicknesses 56. Further, device 10 may be structured to allow engagement of body 14 with pin 62 prior to movement of body 14 into opening 64, so as to provide a self-aligning interaction of body 14 with opening 64. Accordingly, second portion 50 of body 14 may have a length generally corresponding to a length of pin 62 that extends from opening 64 in the opened position. In an example this length may be between about 1.2 cm and 2.0 cm. Further, the overall length of body 14 may be sufficient to cause the desired movement of pin 62 into the closed position, including contact of cap 34 with face 66, and without interference of body with additional internal features of appliance 12, including remaining portions of position switch 52. In an example, body 14 may have an overall length of between 2.0 cm and 3.0 cm.

Still further, tabs 28 may be structured so as to provide a snap- or press-fit arrangement with opening 64, while still allowing device 10 to be engaged with opening 64 using an appropriate amount of force to facilitate easy engagement and disengagement of body 14 with opening 64. This may include structuring tabs 28 so as to extend outwardly from body 14 by a length that is slightly oversized with respect to, for example, a radius of opening 64, such as by between 1 and 5%. Further, tabs 28 may be made to extend relatively farther from or closer to body 14 depending on the internal structure of openings 64, which may include an internal sleeve that may align with opening 64 itself.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A method for selectively restricting movement of an appliance position switch, including a pin, from a closed position to an open position, comprising:

positioning the pin, when in the open position, within a channel of a body portion of a switch retention device;

moving the body of the switch retention device in a first direction into an opening in a face of the appliance within which the pin is moveable from the open position to the closed position with the pin in the channel to cause movement of the pin in the first direction toward the closed position;

continuing to move the switch retention device in the first direction such that a tab extending outwardly from the body flexes inward to move through the opening by deformation of the body within a portion thereof within which the channel extends, the tab subsequently engaging with the opening to retain the switch retention device in the opening and the pin in the closed position.

2. The method of claim 1, further including removing the switch retention device from the opening by movement thereof in a second direction opposite the first direction, thereby allowing the pin to move into the open position.

3. The method of claim 1, wherein the pin engages with an inside surface opposite the face in snap- or press-fit arrangement.

4. The method of claim 1, wherein the pin is biased toward the open position by a spring force and the movement of the switch retention device in the first direction is against the spring force.

5. The method of claim 1, wherein:

the body portion of the position switch retention device extends along an axis and includes a first end defining a tip that is rounded with respect to a first plane through the axis; and moving the body of the switch retention device in the first direction into the opening in the face of the appliance includes moving the tip through the opening.

6. The method of claim 5, wherein the body defines a curved, sloping profile extending away from the tip with respect to a second plane perpendicular to the first plane, the sloping profile facilitating movement of the body in the first direction into the opening.

7. The method of claim 1, wherein:

the channel of the position switch retention device is further continuously open from on the first end to on a side of the body; and positioning the pin within the channel of the body portion of the switch retention device includes moving a portion of the pin through the side of the body though the continuously open channel.

8. The method of claim 1, wherein:

the body of the position switch retention device further defines a generally U-shaped profile extending along the axis within a second portion of the body;

the channel further extends through the second portion of the body; and positioning the pin within the channel of the body portion of the switch retention device includes fitting the U-shaped portion over a portion of the pin.

9. The method of claim 1, wherein continuing to move the switch retention device in the first direction further causes a cap of the body to contact the face of the appliance when the tab extending outwardly from the body engages with the opening.

10. The method of claim 1, wherein:

the position switch retention device further includes a second tab extending from the body opposite the first tab; and continuing to move the switch retention device in the first direction is further such that the second tab engages with the opening to further retain the switch retention device in the opening and the pin in the closed position.

11. The method of claim 1, wherein:

the channel of the position switch retention device extends substantially through the body from the first end to the second end;

an inside surface of the cap encloses the channel relative to the second end of the body; and moving the body of the switch retention device in a first direction initially moves an end of the pin into contact with the inside surface of the cap.

12. The method of claim 1, wherein:

the pin is electrically coupled with a light of the appliance such that, when in the closed position, the light is in an un-illuminated condition and, when in the open position, the light is in an illuminated condition; and by retaining the switch retention device in the opening and the pin in the closed position, the light is maintained in the un-illuminated condition.

13. A method for selectively restricting movement of an appliance position switch, including a pin, from a closed position to an open position, comprising:

positioning the pin, when in the open position, within a channel of a body portion of a switch retention device, the channel continuously open from on the first end to on a side of the body such that positioning the pin within the channel of the body portion of the switch retention device includes moving a portion of the pin through the side of the body though the continuously open channel;

moving the body of the switch retention device in a first direction into an opening in a face of the appliance within which the pin is moveable from the open position to the closed position with the pin in the channel to cause movement of the pin in the first direction toward the closed position;

continuing to move the switch retention device in the first direction such that a cap thereof contacts the face and a tab extending outwardly from the body engages with the opening to retain the switch retention device in the opening and the pin in the closed position.

14. The method of claim 13, wherein the pin engages with an inside surface opposite the face in snap- or press-fit arrangement.

15. The method of claim 13, wherein the pin is biased toward the open position by a spring force and the movement of the switch retention device in the first direction is against the spring force.

16. The method of claim 13, wherein:

the body portion of the position switch retention device extends along an axis and includes a first end defining a tip that is rounded with respect to a first plane through the axis; and moving the body of the switch retention device in the first direction into the opening in the face of the appliance includes moving the tip through the opening.

17. The method of claim 16, wherein the body defines a curved, sloping profile extending away from the tip with respect to a second plane perpendicular to the first plane, the sloping profile facilitating movement of the body in the first direction into the opening.

18. The method of claim 13, wherein:

the tab of the position switch retention device flexes inward by deformation of the body within a portion thereof within which the channel extends; and continuing to move the switch retention device in the first direction causes the tab to flex inwardly to move through the opening and engage with the opening.

19. The method of claim 13, wherein:

the position switch retention device further includes a second tab extending from the body opposite the first tab; and continuing to move the switch retention device in the first direction is further such that the second tab engages with the opening to further retain the switch retention device in the opening and the pin in the closed position.

20. The method of claim 13, wherein:

the channel of the position switch retention device extends substantially through the body from the first end to the second end;

an inside surface of the cap encloses the channel relative to the second end of the body; and moving the body of the switch retention device in a first direction initially moves an end of the pin into contact with the inside surface of the cap.

* * * * *